US006273417B1

(12) United States Patent
Berlingen et al.

(10) Patent No.: US 6,273,417 B1
(45) Date of Patent: Aug. 14, 2001

(54) DELIVERY FOR SHEET PROCESSING PRINTING MACHINE

(75) Inventors: Detlev Berlingen, Heidelberg; Bernd Heller, Neckargemünd, both of (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/537,886

(22) Filed: Mar. 29, 2000

(30) Foreign Application Priority Data

Mar. 29, 1999 (DE) ..... 199 14 302

(51) Int. Cl.[7] ..... B65H 29/00; B65H 29/68

(52) U.S. Cl. ..... 271/183; 271/195; 271/204; 271/211

(58) Field of Search ..... 271/201, 204, 271/211, 309, 183, 195; 399/114

(56) References Cited

U.S. PATENT DOCUMENTS

| | | | | |
|---|---|---|---|---|
| 3,556,519 | | 1/1971 | Keller . | |
| 4,026,542 | * | 5/1977 | Stange et al. | 271/236 X |
| 4,033,579 | * | 7/1977 | Stange et al. | 271/195 |
| 4,225,129 | * | 9/1980 | Zimmermann et al. | 271/204 |
| 4,405,125 | * | 9/1983 | Kulpa et al. | 271/195 |
| 4,479,645 | * | 10/1984 | Pollich | 271/183 |
| 5,222,726 | * | 6/1993 | Vits | 271/195 |
| 5,259,608 | | 11/1993 | Pollich . | |
| 5,265,536 | | 11/1993 | Millard . | |
| 5,816,155 | | 10/1998 | Stephan . | |

FOREIGN PATENT DOCUMENTS

| | | |
|---|---|---|
| 195 01 874 A1 | 7/1996 | (DE) . |
| 195 03 110 A1 | 8/1996 | (DE) . |

* cited by examiner

*Primary Examiner*—Christopher P. Ellis
*Assistant Examiner*—Kenneth W Bower
(74) *Attorney, Agent, or Firm*—Herbert L. Lerner; Laurence A. Greenberg; Werner H. Stemer

(57) ABSTRACT

A delivery for a sheet processing printing machine having a delivery housing and a sheet conveyor substantially enclosed by the delivery housing, the delivery housing being formed with an opening at the underside thereof through which, operationally, sheets leave the delivery housing for forming a sheet pile, and a suction line connected to the interior of the delivery housing, the suction line having a negative pressure prevailing operationally therein, includes motor-driven fluid flow machines for acquiring air flows leaving the delivery housing through the opening and for generating air flows returning into the delivery housing.

4 Claims, 2 Drawing Sheets

DELIVERY FOR SHEET PROCESSING PRINTING MACHINE

BACKGROUND OF THE INVENTION

Field of the Invention

The invention relates to a delivery for a sheet processing printing machine having a delivery housing and a sheet conveyor that is substantially enclosed by the delivery housing. The delivery housing is also formed with an opening at the underside thereof through which, operationally, the sheets leave the delivery housing for forming a sheet pile or stack. A suction line wherein a negative pressure operationally prevails is also connected to the interior of the delivery housing. The delivery is usually surrounded by a sheet processing printing machine.

A delivery of the foregoing general type has become known heretofore from the published German Patent Document DE 195 01 874 A1, for example. Air flows from different sources prevail in the delivery housing of this well-known delivery. Normally, the sheet conveyor includes revolving endless conveyor chains and gripper systems carried thereby which are located in the vicinity of the outer wall of the delivery housing. The conveyor chains and grippers transport a sheet from one processing station to the vicinity of the opening in the underside of the delivery housing, and release the sheets to form sheet piles, after which the gripper systems return to the processing station. The gripper systems generate a drag air flow along the path they traverse, the air flow reaching especially into the region of the opening.

The gripper systems usually carry the sheet over an air cushion formed between them and a sheet gliding surface, the cushion being generated by air blown into the delivery housing. This air also generates an air flow that reaches the opening of the delivery housing.

To avoid collisions of the sheets released for forming a sheet pile, blowing or blasting devices are normally provided above the opening formed in the delivery housing for increasing the descent speed of the sheets released for pile formation or stacking. The blast air is directed directly to the opening.

As has become known heretofore from U.S. Pat. No. 5,265,536, for example, the sheets transported to the stacking or pile forming station are dusted with powder on the way to prevent the freshly printed sheets from sticking together. However, the total amount of the powder released from the dusting device will not stick to the sheets; instead, a cloud of stray powder develops which is then carried in the direction of the delivery housing opening by the hereinaforedescribed air flows.

In order to suck the stray powder from the delivery housing, a suction line having an operationally prevailing negative pressure therein is connected to the interior of the delivery housing, for such conventional deliveries. The suction line communicates in different ways with the interior of the delivery housing. In the aforementioned heretofore known deliveries, a suction opening is provided, for example, in an upper housing wall, for example, of the delivery, whereas in the delivery heretofore known from the German Utility Model DE 298 05 248 U1, the delivery is connected with a suction line located at the suction opening arranged at the side of the path traversed by the sheets.

The aforedescribed deliveries have in common that the air flows loaded with powder cannot be prevented from escaping out of the opening. Such air flows are generated by blast or blowing devices which accelerate the descent of the sheet released for stacking or sheet piling. In addition, enormous suction power is required to prevent the remaining air flows in the delivery housing from leaving the opening.

SUMMARY OF THE INVENTION

It is accordingly an object of the invention to provide a delivery for a sheet-processing printing machine with the task of keeping the surroundings thereof virtually free of powder.

With the foregoing and other objects in view, there is provided, in accordance with one aspect of the invention, a delivery for a sheet processing printing machine having a delivery housing and a sheet conveyor substantially enclosed by the delivery housing, the delivery housing being formed with an opening at the underside thereof through which, operationally, sheets leave the delivery housing for forming a sheet pile, and a suction line connected to the interior of the delivery housing, the suction line having a negative pressure prevailing operationally therein, comprising motor-driven fluid flow machines for acquiring the air flows leaving the delivery housing through the opening and for generating air flows returning into the delivery housing.

In accordance with another feature of the invention, the fluid flow machines are axial blowers.

In accordance with a further feature of the invention, the delivery includes flow shafts disposed for separating from one another the air flows leaving through the opening, and the air flows returning into the delivery housing.

In accordance with a concomitant aspect of the invention, there is provided a sheet processing printing machine assembly comprising a sheet processing printing machine, and a delivery having a delivery housing and a sheet conveyor substantially enclosed by the delivery housing, the delivery housing being formed with an opening at the underside thereof through which, operationally, sheets leave the delivery housing for forming a sheet pile, a suction line connected to the interior of the delivery housing, the suction line having a negative pressure prevailing operationally therein, and motor-driven fluid flow machines for acquiring the air flows leaving the delivery housing through the opening and for generating air flows returning into the delivery housing.

Motor-driven fluid flow or air turbo machines are provided for solving this task; the machines acquire air flows coming from the opening and generate air flows returning into the delivery housing.

In contrast with the current state of the art, this solution does not prevent the air laden with powder from escaping out of the opening, but rather, such escape is permitted in that the air flows discharging from the opening are hindered from spreading the powder into the surroundings of the delivery. The German Utility Patent (DE GM) 91 15 032 suggests that suction pieces or nozzles be grouped in an upper region of a sheet pile formed by the sheets and connected by a suction aggregate, so that this constellation also requires an enormous suction power of the suction aggregate. Keeping the air in the surroundings of the delivery clean can only be accomplished with the arrangement suggested by this reference at the price of a clearly reduced performance.

Other features which are considered as characteristic for the invention are set forth in the appended claims.

Although the invention is illustrated and described herein as embodied in a delivery for a sheet processing printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

BRIEF DESCRIPTION OF THE DRAWINGS

Fig, 2 is an enlarged fragmentary view of FIG. 1 showing one of the fluid flow machines or blowers thereof in simplified form.

DESCRIPTION OF THE PREFERRED EMBODIMENTS

Figure 1:
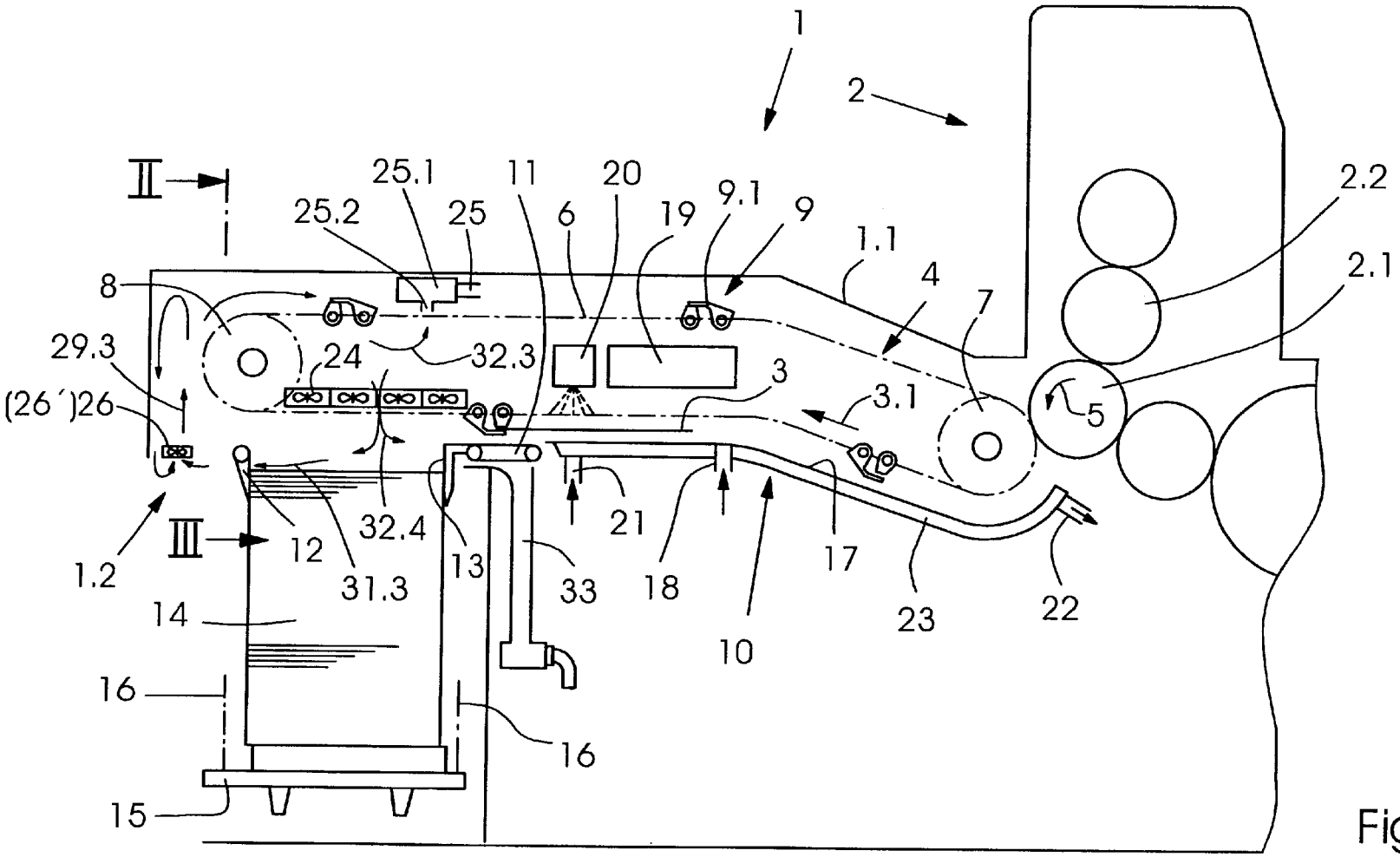
FIG. 1 is a fragmentary diagrammatic side elevational view of a sheet processing rotary printing machine including a delivery.

Referring now to the drawings and, first, particularly to FIG. 1 thereof, there is shown therein a delivery 1 following after the last processing station of a printing machine. Such a processing station can be a printing device or a post-treatment device, such as a varnishing unit. In this example, the final processing station is formed of an offset printer 2 with an impression cylinder 2.1. The cylinder 2 guides the sheet 3 in the processing direction represented by the arrow 5 through a printing nip between the impression cylinder 2.1 and a cooperating offset blanket cylinder 2.2, and conveys it thereafter, to a sheet conveyor 4, formed here as a chain conveyor, by opening two grippers for gripping a leading end of the sheet 2.1 at a gripper border or margin thereof. The conveyor 4 is formed of two conveyor chains 6, one of which revolves along a respective side wall of the chain delivery 1. Each conveyor chain 6 is wound around two synchronously driven chain wheels 7 having rotary axes which are aligned with one another and, in this example, is guided over a deflecting or reversing sprocket wheel 8 located downline and opposite the drive sprocket wheels 7, as viewed with respect to the processing direction 3.1. Gripper systems 9 with grippers 9.1 extend between the two conveyer chains 6 which carry them. They drive through gaps formed between the grippers mounted on the impression cylinder 2.1 and take over a sheet 3 by gripping the gripper border at the leading end of the sheet 3 directly prior to the opening of the grippers disposed on the impression cylinder 2.1 and transport it via a sheet guiding device to a sheet brake 11. Then the grippers open for conveying the sheet 3 to the sheet brake 11. This imparts to the sheet 3 a lower stacking or pile forming speed in comparison with the processing speed, and releases the sheet after that stacking or pile forming speed has been attained, so that the then retarded sheet 3 meets the front or leading edge stops 12 and forms a stack or pile 14 with previous and/or following sheets 3 after they have been aligned at opposite rear or trailing edge stops 13. The pile 14 is lowerable by a piston device to an extent matching the growth of the pile 14. The piston device is represented in FIG. 1 only by the platform 15 thereof carrying the pile 14, and the platform-carrying lifting chains 16 shown in phantomx, i.e., by dot-dash lines.

The conveyor chains 6 are guided along the path thereof on chain guiding tracks between the drive sprocket wheels 7, on the one hand, and the deflecting sprocket wheels 8, on the other hand. The tracks determine the chain paths of the chain strand. In this example, the sheets 3 are transported by the lower chain strand shown in FIG. 1. This section or length of the chain path is matched by a sheet guiding surface 17 facing towards the chain path, the guiding surface 17 being formed on the sheet guiding device 10. Between the guiding surface 17 and the sheet 3 passing thereover, an air cushion is preferably operationally provided. For this purpose, the sheet guiding device 10 is provided with blast air nozzles or jets terminating in the sheet guiding surface 17; the blast air nozzles are symbolically represented in their entirety in FIG. 1 by a connecting piece 18.

In order to prevent the printed sheets 3 in the pile 14 from sticking together, a dryer 19 and a powder sprayer 20 are provided on the path of the sheet 3 from the drive sprocket wheels 7.

To prevent excessive heating of the sheet guiding surface 17 by the dryer 19, a coolant circuit 10 is integrated in the sheet guiding surface 17 and is symbolically represented in FIG. 1 by an inlet connector 21 and an outlet connector 22 on a coolant tank 23 assigned to the sheet guiding surface 17.

To accelerate the descent of the released sheets 3 onto the pile 14, the sheets are subjected to the pressure of air from above. The air is operationally generated in this exemplary embodiment by a number of fans or ventilators 24 which are arranged for the most part above the pile 14. Some of the fans or ventilators 24 arranged opposite the pile 14 with respect to the conveying direction of the sheets 3 are upline therefrom and assist in feeding the sheets 24 to the sheet brake.

The delivery includes a delivery housing 1.1 which is formed on underside thereof with an opening 1.2 through which the sheets 3 released for forming the pile 14 leave the delivery housing 1.1.

Inside the delivery housing 1.1, the atmosphere is loaded with powder from the stray powder sprayed by the powder sprayer 20.

The interior space of the delivery housing 1.1 is connected with a suction line 25 wherein negative pressure prevails. The suction line 25 is attached, on the one hand, to a non-illustrated negative pressure generator and, on the other hand, to a suction shaft 25.1 which has at least one suction opening 25.2.

Figure 2:
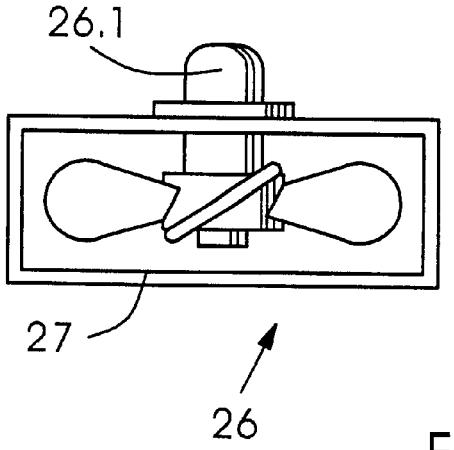
Figure 3:
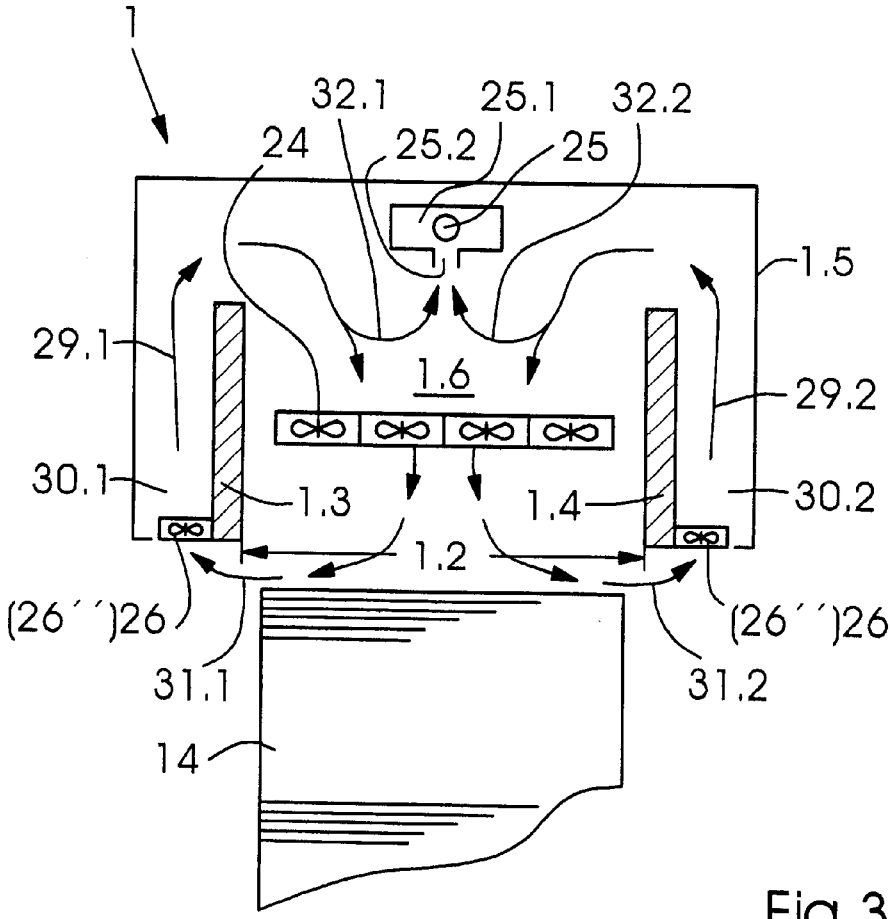
FIG. 3 is a cross-sectional view of FIG. 1 taken along the line identified by II, in the direction of the arrow.

FIGS. 1 and 3 represent, in only a stylized fashion, the motor-driven fluid-flow or turbo engines 26 which are assigned to the opening 1,2. They are preferably constructed as axial blowers with an integrated drive motor 26.1 and are, as for one of the fluid flow or turbo machines shown in FIG. 2, diagrammatically and only by way of example, mounted on a frame construction 27. The fluid flow or turbo machines 26 are disposed, with respect to the opening 1.2 of the delivery housing 1.1, in a manner that they operationally capture the air flows discharging from the opening 1.2.

Especially in the case wherein the blowers or ventilators 24 or similar blast air generators are provided to accelerate the descent of the sheets 3 onto the pile 14, a current generating air flows discharging from the opening 1.2 is initially directed downwardly. In the further course of this current, it is deflected at the descending sheet 3 so that air flows result which flow down laterally. Lateral has the meaning in this instance that the downflowing air flows are directed substantially crosswise to the sheet transport direction 3.1 and in and opposite to the sheet transport direction 3.1.

The turbo machines 26 are preferably arranged at the opening 1.2 in a manner that the air flows leaving the delivery housing 1.1 arrive within the range of influence of the suction sides of the turbo machines 26 over a path that is as short as possible. In this embodiment, this is realized as follows:

A partial number of the fluid flow or turbo machines 26 forms a first row 26' of axial blowers with vertically directed rotary axes arranged adjacent one another. This first row 26' extends perpendicularly to the sheet transport direction 3.1 (perpendicularly to the plane of FIG. 1) at least over the corresponding expanse of the opening 1.2. With respect to the sheet transport direction 3.1, the first row 26' of axial blowers is inserted at the end of the downstream opening 1.2 in a manner that the horizontal projection of this first row 26' of axial blowers is located in close vicinity of the horizontal projection of the pile 14. The remainder of the fluid flow or turbo machines 26 forms a second row 26" and a third row 26'" of axial blowers arranged adjacent one another with also vertically aligned rotary axes.

As is apparent from FIG. 3, the opening 1.2 is limited at its sides by respective side walls 1.3 and 1.4 of the delivery. The side walls 1.3 and 1.4 carry the sheet conveyor, which is not shown in FIG. 3. On the sides of each side wall 1.3 and 1.4 facing away from the opening 1.2 and also above these side walls, a housing wall 1.5 is arranged at a distance from the side walls 1.3 and 1.4 and the upper front areas of the side walls 1.3 and 1.4. This housing wall 1.5 forms an inner space 1.6 of the delivery housing 1.1 extending substantially to a lower level whereon the lower front planes of the side walls 1.3 and 1.4 are located. The second row 26" of the turbo machines 2.6 and the third row 26'" of the turbo machines 26 are arranged between the side wall 1.4 and the housing wall 1.5.

The suction sides of the turbo machines 26 face the air flows leaving the opening 1.2. In this exemplary embodiment, these suction sides face downwardly.

The second and the third rows 26" and 26'", respectively, of the turbo machines 26 extend along the expanse of the opening in the sheet transport direction 3.1. The air flows 29.1 and 29.2 generated by the turbo machines combined in these rows 26" and 26'" flow from the outside of the delivery housing 1.1 back into the delivery housing 1.1 and are guided in the flow shafts 30.1 and 30.2, respectively, formed between the side walls 1.3 and 1.4, on the one hand, and the housing wall 1.5, on the other hand. These flow shafts 30.1 and 30.2 create a division within the delivery housing 1.1 between the backward flowing air flows 29.1 and 29.2, on the one hand, and the air flows 31.1 and 31.2, on the other hand, which are discharging from the opening 1.2, so that targeted circulating flows result which re-enter the delivery housing 1.1 after leaving the opening 1.2. The respective direction of rotation of these circulating flows is represented by arrows in FIG. 3.

As represented in FIG. 1 by the respective arrows, the first row 26' of the turbo machines 26 also generates a circulating flow surrounding the air flows 29.3 returning into the delivery housing 1.1 and the air flows 31.3 discharging from the opening 1.2. The circulating flows are shown in FIGS. 1 and 3, respectively, separate from one another although they follow a course deviating from the illustration due to the combined effect of the two flows. The representation shows only the influence of one of the circulating flows on the total flow generated thereby.

The total flow is subject to the influence of at least one suction opening 25.2. It is disposed so that it removes the partial flows 32.1, 32.2 (according FIG. 3) and 32.3 (according to FIG. 1) from the total flow.

In total, a continuous circulation of the air laden with stray powder can be realized above the pile 14 by continuously sucking the powder from the air in the partial flows 32.1, 32.2 and 32.3 flowing into at least one suction opening 25.2. The sucking-away of the powder is realized without a suction aggregate requiring considerable power. Such an aggregate would be needed without the circulation in order to provide the suction opening 25.2 with a remote effect of such strength that it would prevent the stray powder from spreading in the vicinity of the delivery 1, while sucking-away a considerable flow volume.

The aforediscussed circulation brings with it another advantage in that the powder emission from the powder sprayer 20 can be decreased because a part of the powder stream that initially does not reach the sheets then reaches the sheets in the drag of the circulating air flows. The part of the powder not sticking to the sheets is entrained by the circulating total flow and is deflected in the direction of the sheets.

As can be seen in FIG. 1, another partial flow 32.4 is removed from the total flow by a suction device with a suction shaft 33 located in the region of the sheet brake 11 and facing towards it. The suction shaft 33 is connected to a non-illustrated negative pressure generator. The embodiment described here is only one of several preferred embodiments.

In another embodiment, a flow shaft is also provided for the first row 26' of turbo machines 26 that divides the returning air flow 29.3 from the air flow 31.3 discharging from the opening.

In another embodiment, the turbo machines 26 constructed as axial blowers are arranged for the returning air flows in a horizontal direction of the rotary axes thereof with a corresponding construction of the flow shafts so that the suction side of the axial blowers face towards the opening 1.2.

We claim:

1. A delivery for a sheet processing printing machine having a delivery housing and a sheet conveyor substantially enclosed by the delivery housing, the delivery housing being formed with an opening at the underside thereof through which, operationally, sheets leave the delivery housing for forming a sheet pile, and a suction line connected to the interior of the delivery housing, the suction line having a negative pressure prevailing operationally therein, comprising motor-driven fluid flow machines for acquiring the air flows leaving the delivery housing through the opening and for generating air flows returning into the delivery housing.

2. Delivery according to claim 1, wherein said fluid flow machines are axial blowers.

3. Delivery according to claim 1, including flow shafts disposed for separating from one another the air flows leaving through the opening, and the air flows returning into the delivery housing.

4. Sheet processing printing machine assembly comprising a sheet processing printing machine, and a delivery having a delivery housing and a sheet conveyor substantially enclosed by the delivery housing, the delivery housing being formed with an opening at the underside thereof through which, operationally, sheets leave the delivery housing for forming a sheet pile, a suction line connected to the interior of the delivery housing, the suction line having a negative pressure prevailing operationally therein, and motor-driven fluid flow machines for acquiring the air flows leaving the delivery housing through the opening and for generating air flows returning into the delivery housing.

* * * * *